US005947306A

United States Patent [19]

Chang

[11] Patent Number: 5,947,306

[45] Date of Patent: Sep. 7, 1999

[54] MODULAR RACK FOR FLOWER POT, VASE, AND THE LIKE

[76] Inventor: Wen-Hsien Chang, P.O. Box 487, Changhua, Taiwan

[21] Appl. No.: 09/069,806

[22] Filed: Apr. 30, 1998

[30] Foreign Application Priority Data

Jan. 23, 1998 [TW] Taiwan ..... 87201384

[51] Int. Cl.[6] ..... A47F 5/00

[52] U.S. Cl. ..... 211/85.23; 211/133.4; 211/205; 248/165; D6/405

[58] Field of Search ..... 211/85.23, 71.01, 211/88.01, 133.4, 205, 208, 107; 248/165, 188.7, 188.8; D6/403, 405, 556, 558

[56] References Cited

U.S. PATENT DOCUMENTS

| | | | |
|---|---|---|---|
| D. 270,122 | 8/1983 | Stein | D6/558 X |
| 1,897,905 | 2/1933 | Johnson | 211/85.23 X |
| 2,794,554 | 6/1957 | Donner | 211/85.23 |
| 3,018,898 | 1/1962 | Frazelle | 211/107 |
| 3,648,892 | 3/1972 | Morgan | 211/205 X |
| 4,068,761 | 1/1978 | McCarthy . | |
| 4,239,171 | 12/1980 | Huls et al. | 248/188.7 X |
| 4,717,105 | 1/1988 | Stefani | 211/103 X |
| 5,178,286 | 1/1993 | Allison | 211/85.23 |

*Primary Examiner*—Robert W. Gibson, Jr.

[57] ABSTRACT

A modular rack is composed of a support tube, a plurality of support arms, and a plurality of trays. The support tube is provided in the wall thereof with a plurality of retaining slots located at various levels of the support tube. The support arms are provided respectively at one end thereof with two retaining protuberances engageable with said retaining slots of the support tube. The trays are fastened respectively with another end of the support arms for holding a flower pot, vase, and the like.

1 Claim, 6 Drawing Sheets

MODULAR RACK FOR FLOWER POT, VASE, AND THE LIKE

FIELD OF THE INVENTION

The present invention relates generally to a rack for holding flower pot, vase, and the like, and more particularly to a modular rack for holding flower pot, vase, and the like.

BACKGROUND OF THE INVENTION

A modular flower rack of the prior art is composed of a base, a plurality of connection members, and a plurality of flower holding frames. The base has a plurality of receiving slots, connection holes, and a protruded portion located at the center thereof and provided with a retaining recess.

The connection members are provided respectively with a retaining portion and a retaining recess. The retaining portion of one of the connection members is engageable with the retaining recess of another one of the connection members. The flower holding frames are provided respectively with a retaining portion and a retaining recess. The retaining portion of the flower holding frames is engaged with the retaining recess of the base, or the retaining recess of the connection members.

Such a prior art flower rack as described above is defective in design in that it can be displayed only on the desktop or the floor or ground, and that the entire framework of the prior art flower rack is made up of the base, the connection members and the flower holding frame, which are not held securely together to prevent the connection members from being slanted when the flower holding frames are loaded with flowers.

SUMMARY OF THE INVENTION

It is therefore the primary objective of the present invention to provide an improved modular rack for flower pots, vases and the like. The improved modular rack can be displayed on a surface or fastened onto a wall.

It is another objective of the present invention to provide an improved modular rack for flower pots, vases and the like. The improved modular rack consists of structural units which are securely held together.

It is still another objective of the present invention to provide an improved modular rack for flower pots, vases and the like. The improved modular rack is versatile in design.

In keeping with the principle of the present invention, the foregoing objectives of the present invention are attained by the modular rack, which is composed of a support tube, a plurality of support arms, and a plurality of trays for holding a flower pot or vase. The support tube is of a hollow construction and is provided in the wall thereof with a plurality of retaining slots. The support arms are provided respectively at one end thereof with two retaining portions engageable with the retaining slots of the support tube. The support arms are further provided respectively at another end thereof with a tray fastened therewith for holding a flower pot, vase, and the like.

The foregoing objectives, features and functions of the present invention will be more readily understood upon a thoughtful deliberation of the following detailed description of the preferred embodiments of the present invention with reference to the accompanying drawings.

DETAILED DESCRIPTION OF THE EMBODIMENTS

Figure 1:
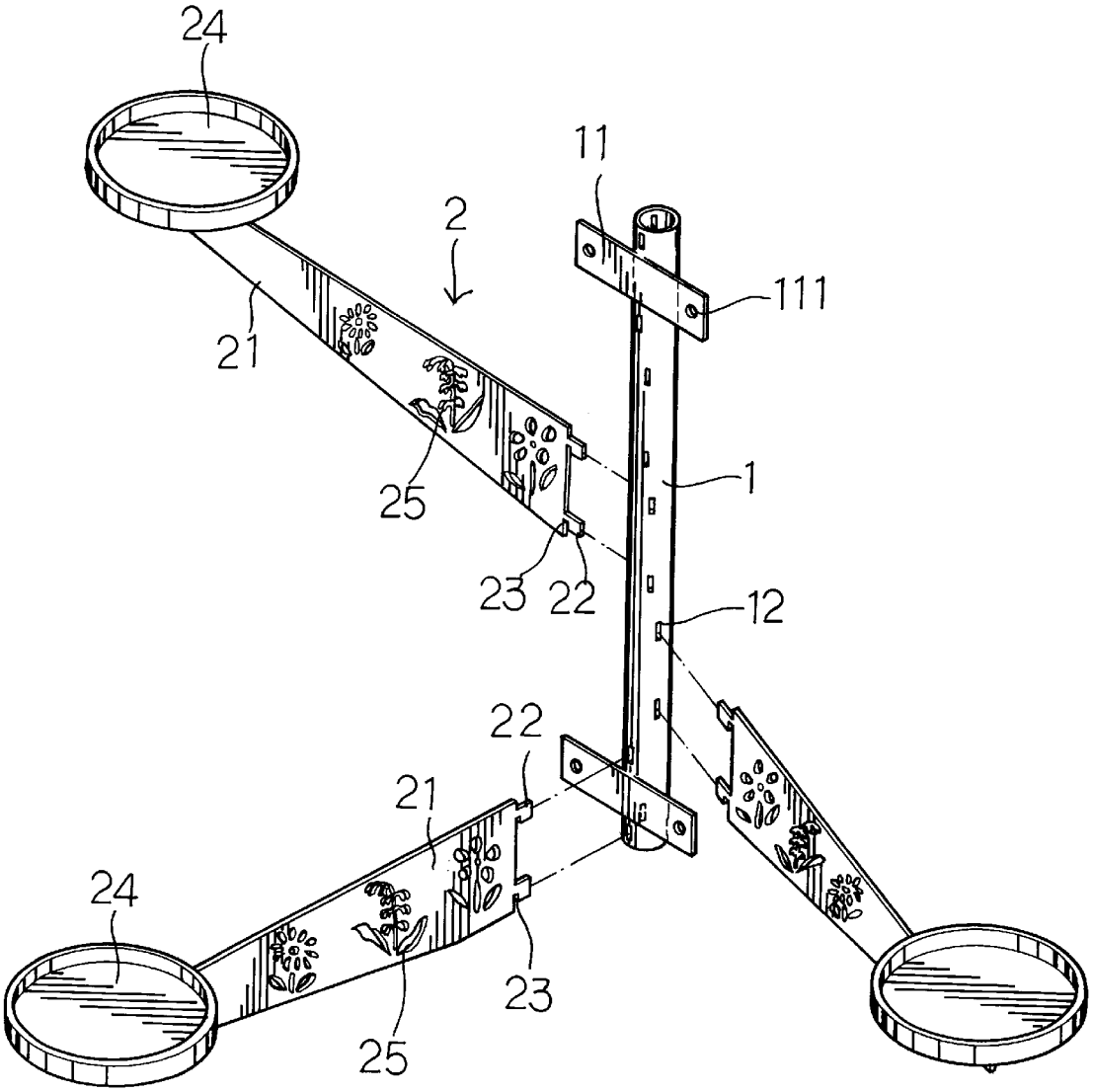
FIG. 1 shows an exploded view of a first preferred embodiment of the present invention.
Figure 2:
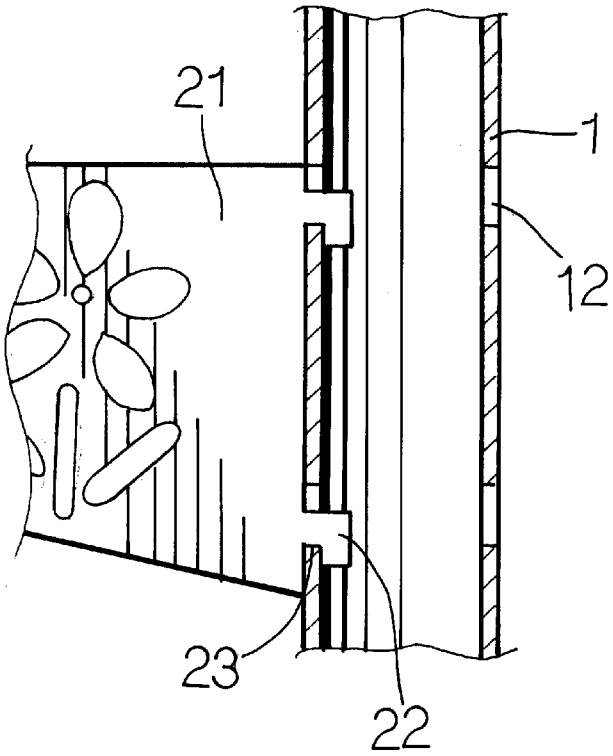
FIG. 2 shows a partial longitudinal sectional view of the present invention in combination.

As illustrated in FIGS. 1 and 2, a modular rack embodied in the present invention is intended to hold the flower pots, vases, and the like, and is composed mainly of a support tube 1 and a plurality of support arms 2.

Figure 3:
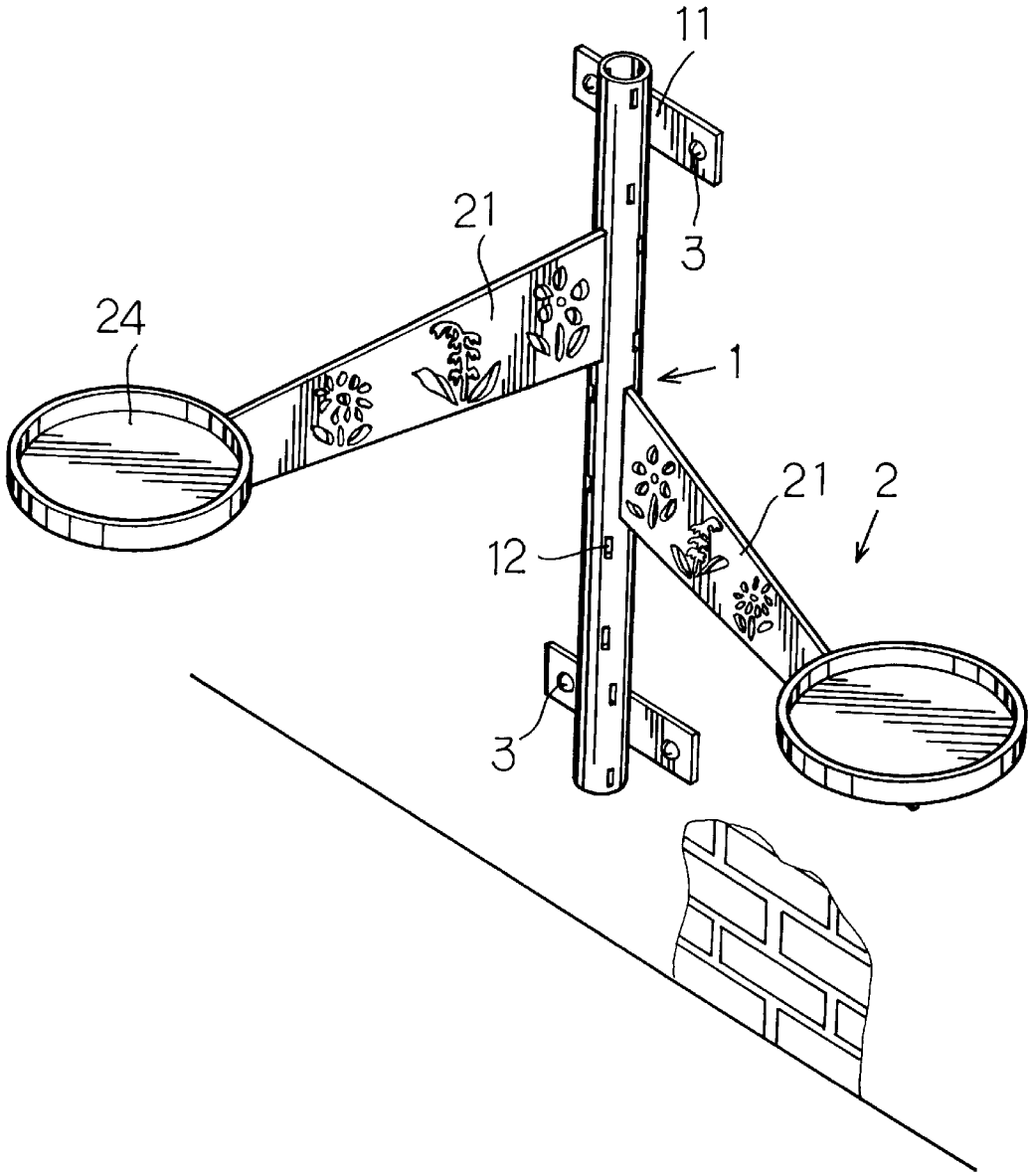
FIG. 3 shows a schematic view of the present invention at work.

The support tube 1 of a metal material and a predetermined length is of a hollow construction and is provided respectively at both ends thereof with a fastening plate 11 fastened therewith. The fastening plate 11 is provided with two fastening holes 111 for fastening the support tube 1 onto a wall by two fastening screws 3, as shown in FIG. 3. The support tube 1 is further provided in the wall thereof with a plurality of retaining slot sets 12 located at various height levels of the support tube 1. Each retaining slot set 12 consists of two slots, which are separated from each other by a predetermined distance.

The support arms 2 are made of a metal plate 21 and are provided respectively at one end thereof with two retaining protuberances 22 which are separated from each other by a distance corresponding with the distance between the two slots of the retaining slot sets 12 of the support tube 1. In other words, the support arms 2 are fastened respectively at one end thereof with the support tube 1 such that the two retaining protuberances 22 are engaged with the two slots of one retaining slot set 12 of the support tube 1. The retaining protuberances 22 are of a hooked construction and are respectively provided with a locating slot 23. The metal plate 21 of each of the support arms 2 is decorated with one or more patterns 25 for giving an added esthetic effect to the support arm 2. The support arms 2 are further provided respectively at another end thereof with a tray 24 fastened therewith by welding for holding a flower pot or vase, and the like.

Figure 4:
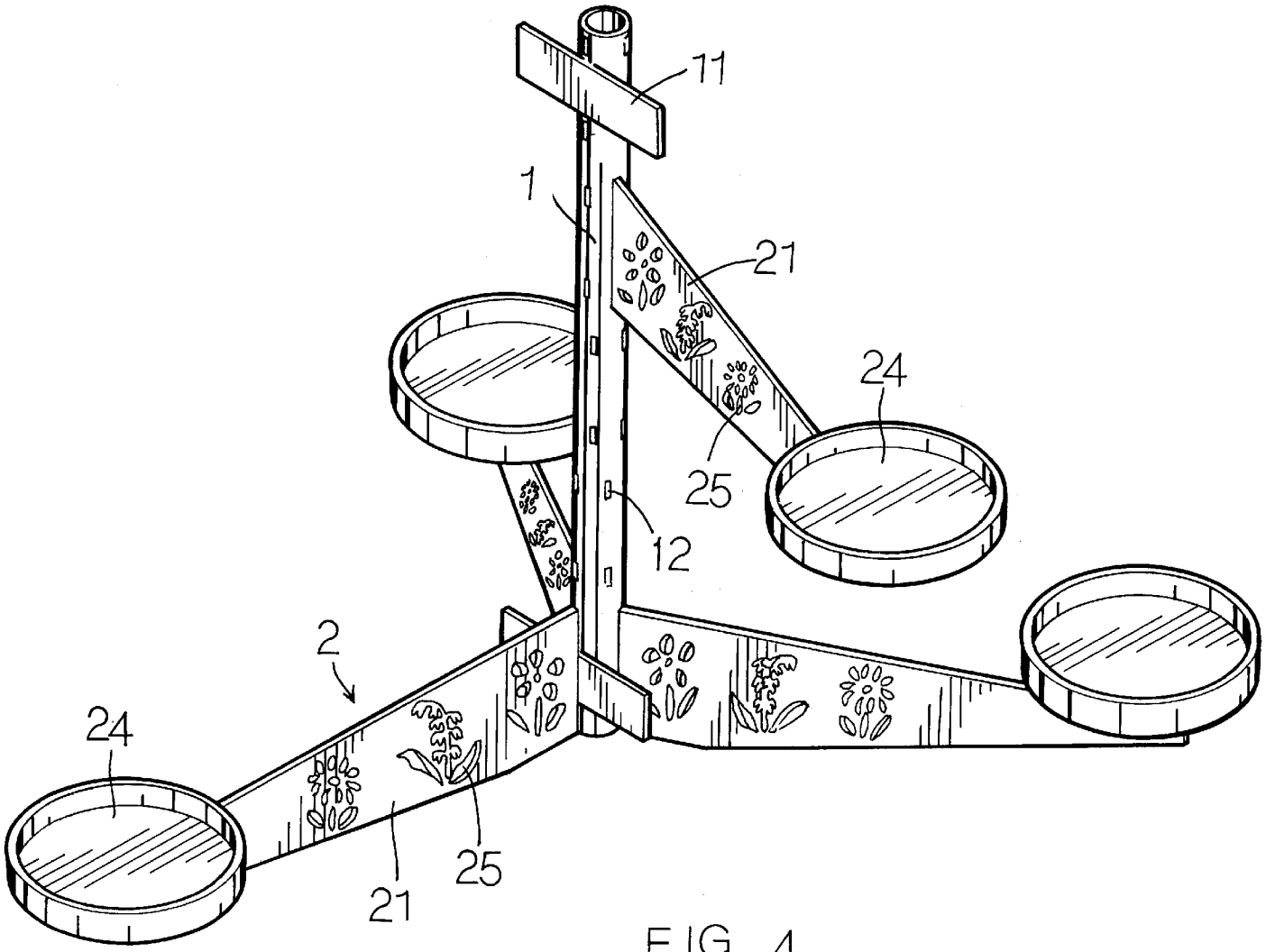
FIG. 4 shows another schematic view of the present invention at work.

The modular rack of the present invention can be placed on a desktop or a floor, as shown in FIG. 4. Three support arms 2 are fastened with the bottom end of the support tube 1 such that the three support arms 2 are located at the same height level of the support tube 1, and that two adjoining support arms 2 form therebetween an angle of 120 degrees. As a result, the modular rack of the present invention can be securely placed on a surface, such as the desktop, floor, or ground surface.

Figure 5:
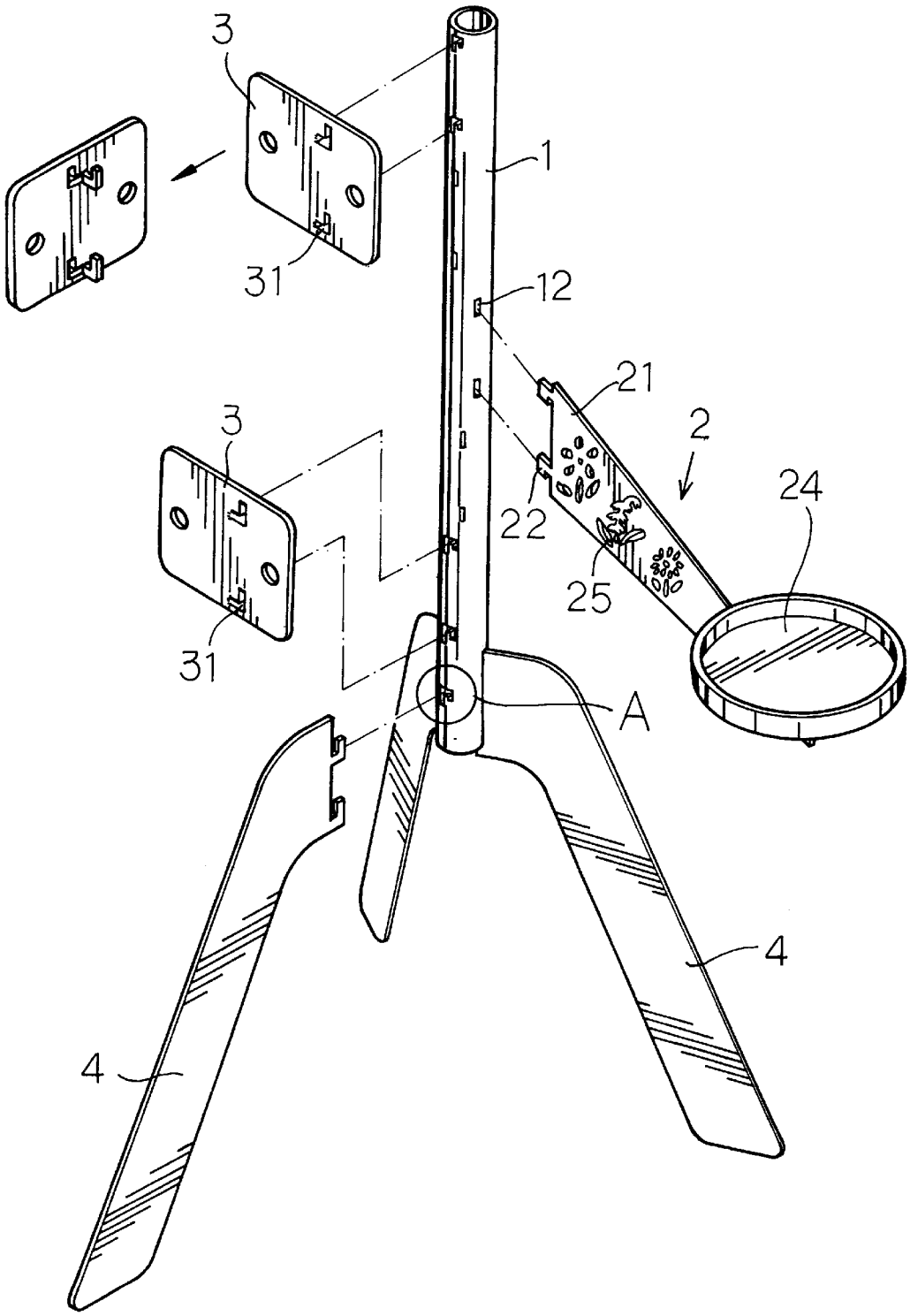
FIG. 5 shows an exploded view of a second preferred embodiment of the present invention.
Figure 6:
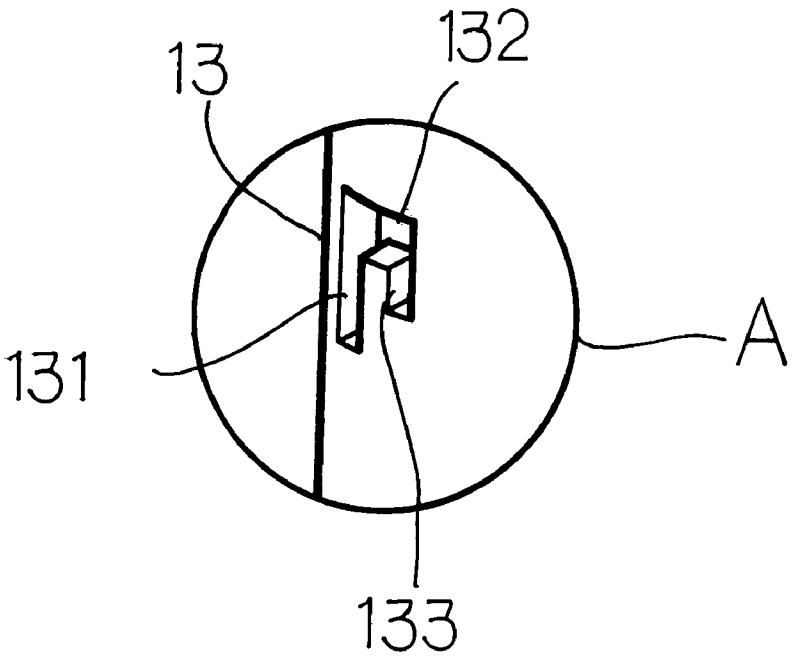
FIG. 6 shows an enlarged view of a portion indicated by a circle "A" as shown in FIG. 5.

As shown in FIG. 5, the modular rack of the second preferred embodiment of the present invention is provided with a tripod consisting of three legs 4 which are fastened respectively at the top end thereof with the bottom portion of the support tube 1. The bottom portion of the support tube 1 is provided with three sets of retaining slots 13. Each retaining slot set consists of two retaining slots 13 of a hooked shape. In other words, the retaining slot 13 is formed of a long longitudinal slot 131, a horizontal slot 132, and a short longitudinal slot 133. The three legs 4 of the tripod are provided respectively at the top end thereof with two retaining protuberances 41 which are engaged with the retaining slots 13 of the bottom portion of the support tube 1. The support tube 1 may be provided with two fastening plates 3 each having two retaining protuberances 31 engageable with the retaining slots 14 of the support tube 1. The fastening plates 3 of the second preferred embodiment is similar in function to the fastening plates 11 of the first preferred embodiment of the present invention.

What is claimed is:

1. A modular rack for flower pot, vase, and the like, said modular rack comprising:

a metal support tube provided in a wall thereof with a plurality of retaining slot sets located at various height levels of said support tube, said retaining slot sets each consisting of two retaining slots separated from each other by a distance, said support tube further provided with two fastening plates fastened therewith and provided respectively with two fastening holes for fastening said support tube onto a wall by two fastening screws engageable with said two fastening holes, said support tube further provided with a tripod;

a plurality of metal support arms provided respectively at one end thereof with two retaining protuberances engageable with said two retaining slots of each of said retaining slot sets of said support tube, said support arms being fastened respectively at said one end thereof with said support tube such that said two retaining protuberances of each of said support arms are engaged securely with said two retaining slots of each of said retaining slot sets of said support tube, said support arms being decorated with one or more patterns; and a plurality of trays corresponding in number to said support arms and fastened respectively with another end of said support arms for holding flower pot, vase, and the like;

wherein said tripod is composed of three legs, said three legs provided respectively at a top end thereof with two retaining protuberances which are engaged with said two retaining slots of said retaining slot sets of said support tube.

* * * * *